US007488264B2

(12) United States Patent
Seaman

(10) Patent No.: US 7,488,264 B2
(45) Date of Patent: Feb. 10, 2009

(54) BASKETBALL PRACTICE ENHANCER

(76) Inventor: Philip Jeffrey Seaman, 16130 Jacaranda Way, Los Gatos, CA (US) 95032

( * ) Notice: Subject to any disclaimer, the term of this patent is extended or adjusted under 35 U.S.C. 154(b) by 761 days.

(21) Appl. No.: 10/707,158

(22) Filed: Nov. 24, 2003

(65) Prior Publication Data

US 2005/0113192 A1 May 26, 2005

(51) Int. Cl.
*A63B 69/00* (2006.01)
*A63B 63/08* (2006.01)

(52) U.S. Cl. ..... 473/433; 473/422; 473/485; 473/488; 473/447

(58) Field of Classification Search ..... 473/422, 473/433, 447, 448, 472, 479–489; 273/317.3; 434/248

See application file for complete search history.

(56) References Cited

U.S. PATENT DOCUMENTS 3,945,638 A 3/1976 Luebkeman
4,522,394 A * 6/1985 Broussard ..... 473/483
4,720,101 A 1/1988 Farkas
4,805,903 A * 2/1989 McArdle ..... 473/489
4,836,539 A 6/1989 Knapp
4,903,964 A * 2/1990 Anderson ..... 473/489
4,921,248 A * 5/1990 Rapp ..... 473/488
5,098,090 A 3/1992 Juhl
5,156,394 A * 10/1992 Deal ..... 473/485
5,165,680 A 11/1992 Cass
5,184,814 A 2/1993 Manning
5,308,059 A 5/1994 Owen
5,338,023 A * 8/1994 Stovall ..... 473/485
5,348,290 A 9/1994 Matherne
5,409,211 A 4/1995 Adamek
5,443,258 A 8/1995 Kinsella
5,575,470 A * 11/1996 Sherman ..... 473/489
5,759,121 A * 6/1998 Rogers et al. ..... 473/488
5,830,088 A 11/1998 de Abreu
6,174,249 B1 * 1/2001 Mattoon ..... 473/485
6,976,927 B2 * 12/2005 Cahill ..... 473/449

* cited by examiner

*Primary Examiner*—Mitra Aryanpour

(57) ABSTRACT

An improved basketball training device is presented. It has a bearing attached to a basketball goal, as well as either a facsimile hoop for attaching on the market chutes or a folding chute. This device allows balls to be returned to any area of the court.

9 Claims, 13 Drawing Sheets

BASKETBALL PRACTICE ENHANCER

BACKGROUND OF INVENTION

Since its inception by Dr. James Naismith in 1891 by nailing a bottomless peach basket to a balcony, the object of basketball is to score a goal by shooting a basketball through a basketball hoop. Scoring proficiency requires a great deal of practice. A variety of inventions have been introduced in recent years to aid in training of basketball players.

Size reducer type inventions force the shooter to improve accuracy in order to make the ball pass through an effectively smaller hoop. An example of a size reducer type invention is U.S. Pat. No. 5,308,059 Owen May 3, 1994. However, these inventions do not offer other features, such as returning the ball to the shooter.

Chute type inventions overcome this shortcoming. Chute inventions are, in general, of one of three categories. The first category returns balls along a line radiating from the center of the hoop. These devices will be referred to as chute only inventions. Examples of these are: U.S. Pat. No. 3,945,638 Luebkeman Mar. 23, 1976; U.S. Pat. No. 5,098,090 Juhl Mar. 24, 1992; U.S. Pat. No. 5,165,680 Cass Feb. 24, 1992; U.S. Pat. No. 5,348,290 Matherne Sep. 20, 1994. None of these chute only inventions can be quickly redirected to address the whole court. Nor do any of them reduce the size of the hoop. All of them require a ladder for installation.

The second category of chutes has some sort of quick redirecting mechanism. These will be referred to as rotatable chutes. These allow the line along which the balls return to be changed by the user redirecting the chute by hand. Thus the shooter may practice shots from all over the court. Examples of this type of invention are U.S. Pat. No. 4,720,101 Farkas Jan. 19, 1988; U.S. Pat. No. 4,836,539 Knapp Jun. 6, 1989; U.S. Pat. No. 5,184,814 Manning Feb. 9, 1993; U.S. Pat. No. 5,409,211 Adamek Dec. 27, 1995; U.S. Pat. No. 5,443,258 Kinsella Dec. 6, 1994; U.S. Pat. No. 5,830,826 de Abreu Nov. 3, 1998. None of these rotatable chute inventions will work with the previously mentioned chute-only mechanisms. None of them fold up small for easy transportation and storage. None have the smooth rotation as that offered by ball bearings.

With one exception all of the rotatable chutes require a ladder to be installed. The exception Adamek U.S. Pat. No. 5,409,211 gets around the use of a ladder by attaching to the net. Besides requiring a net to be used, performance suffers in that the invention can easily be made to sway and is designed specifically not to freely rotate via the use of grooves or notches to prevent rotation. Hence extra time is needed to reposition the chute. Because it attaches to the net it is relatively close to the ground such that a player may knock his head or shoulder on it. It interferes with the play area.

De Abreu U.S. Pat. No. 5,830,088 uses ropes. These ropes interfere with the court and may cause players to trip or fall.

The third category of chutes sits in the basketball court rather than hanging from the basketball goal. These are large, thus difficult to transport and store and interfere with the playing area.

Accordingly, several objects of the present invention are:

to provide a means by which chute only devices can address the whole court;

to provide a means by which the device can be taken on and off the basketball goal without a ladder;

to provide a means by which the device can fold into a compact size for easy transport and storage.

Additional embodiments are disclosed which provide further objects and advantages which are:

to provide a means to reduce the effective size of the basketball hoop thus requiring better aim by the shooter.

to provide an attachable chute that can be folded for easy transportation and storage and reduces the overall weight due to the removal of the facsimile hoop.

to provide a means whereby the device will not interfere with the top surface of the basketball goal and thus does not interfere with balls striking the top surface of the basketball goal while being firmly connected to the goal. This maintains a game-like performance of the basketball goal while still providing beneficial training features.

to provide a means that makes theft of the device more difficult.

Still further objects and advantages will become apparent from a consideration of the ensuing description and drawings.

A device is presented which provides a rotatable facsimile hoop just beneath the basketball goal. To this facsimile hoop, chute-only devices can be attached which otherwise cannot quickly be adjusted to return balls to any area of the court. The device includes a bearing containing ball bearings for smooth rotation. This device is held to the goal by means of hooks. These hooks are shaped to allow attachment to and removal from the goal without the use of a ladder by means of a shepherds crook. The hooks are attached to the bearing by means of latching hinges that latch when folded down. Thus the hooks will not move out of place when folded. The device is thus a relatively rigid and compact assembly when folded for transportation. There are not any hooks sticking up or flopping about to catch on things or unattached pieces to lose. This will be called the initial embodiment.

Two additional embodiments are presented. In the first additional embodiment the size of the facsimile goal is smaller making it harder for shots to be made.

In the second additional embodiment the bearing attaches directly to the basketball goal support. This embodiment offers no interference with the top of the goal that is critical to maintaining a true basketball-game like performance of the device. Rather than attaching via hooks as in the first embodiment, it is permanently attached to the goal via the goal support. This makes it more difficult to steal.

The second additional embodiment has no facsimile hoop and in its place an attachable folding chute is also disclosed. This chute can be attached to and removed from the bearing without a ladder by means of a shepherd's crook shaped differently than the first embodiment. The chute folds up small for easy transport and storage.

[Reference Numerals]

Figure 1:
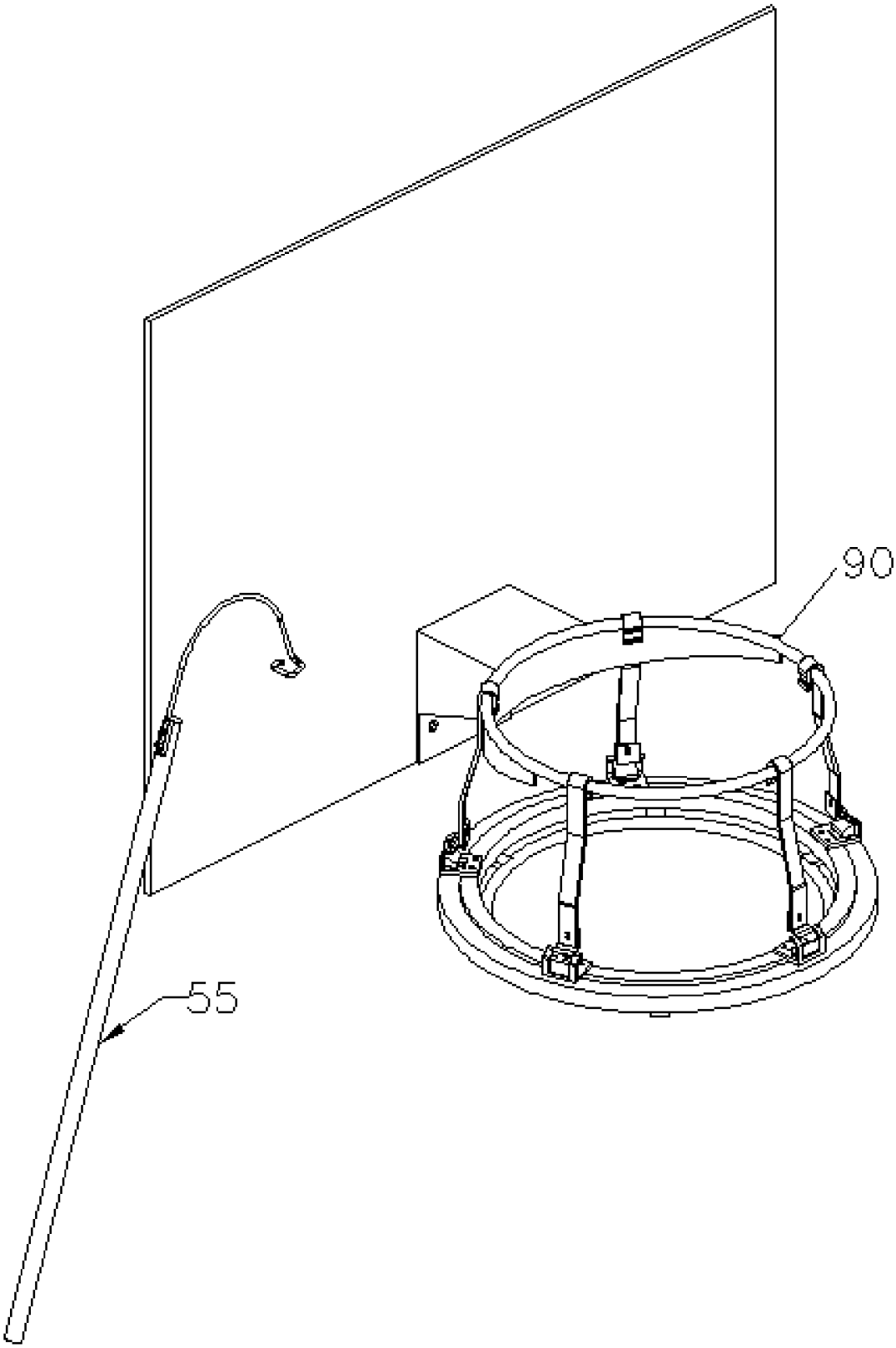
FIG. 1 is a perspective view of the invention connected to a basketball goal including the backboard and shepherds crook in accordance with the present invention.

| | | | |
|---|---|---|---|
| 30 | Outer Bearing | 52 | Bolt |
| 31 | Inner Bearing | 55 | Shepherds Crook |
| 32 | Ball Bearing | 56 | Shepherds Crook Shaft |
| 33 | Plug | 57 | Shepherds crook Hook |
| 40 | Hoop Hook | 58 | Bolt for Shepherds Crook |
| 41 | Hinge | | |
| 50 | Facsimile Hoop | 59 | Nut for Shepherds C |
| 51 | Alt Facsimile Hoop | 90 | Goal |

[Reference Numerals Second Alternate Embodiment]

| | | | |
|---|---|---|---|
| 30' | Outer Bearing | 64 | Right Rear Support |
| 31' | Inner Bearing | 65 | Left Front Support |
| 55' | Alt Shepherds Crook | 66 | Right Front Support |
| 56' | Alt Shepherds Shaft | 67 | Rivet |
| 60 | Folding Chute Assy | 68 | Detent |
| 60L | Folding Chute Left | 69 | Detent |
| 60R | Folding Chute Right | 70 | Bearing Assembly |
| 61 | Left Rail | 72 | Stay |
| 62 | Right Rail | 73 | Nut |
| 63 | Left Rear Support | 91 | Goal |

DETAILED DESCRIPTION

Referring now to FIG. 1, the basketball-training device is used in combination with a standard basketball hoop (90). A shepherds crook (55) allows the invention to be lifted up to a basketball hoop (90), installed, and removed without the use of a ladder.

Figure 2:
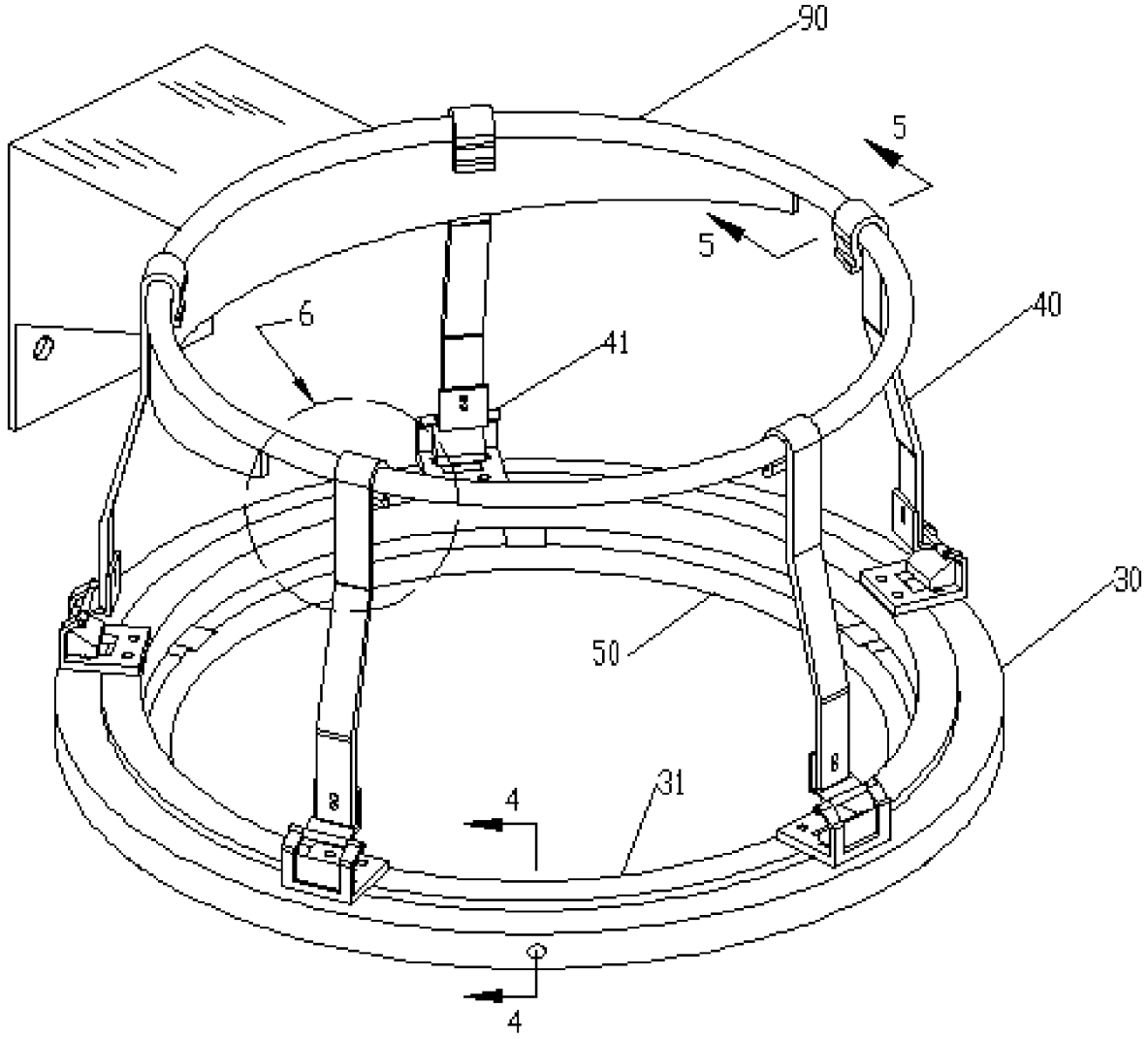
FIG. 2 is a perspective view of the invention connected to a basketball hoop.

Referring now to FIG. 2, shown is an outer bearing member (30), an inner bearing member (31), a facsimile hoop (50), a number of hooks (40) and hinges (41).

The hooks (40) hold the device to the basketball goal (90). The hooks (40) are discussed further regarding FIGS. 5 and 6 below.

The hinges (41) hold the hooks (40) to the inner bearing (31). The hinges (41) allow the hooks (40) to be folded down making the invention to be less tall for easier storage and transportation. This is discussed further in FIGS. 7 and 7*a*.

The outer bearing (30) rotates with respect to the inner bearing (31). The facsimile goal (50) is attached to the outer bearing (30) and thus can also rotate with respect to the inner bearing (31) and consequently the basketball goal (90). The bearing is discussed further in FIG. 4 below.

Figure 2A:
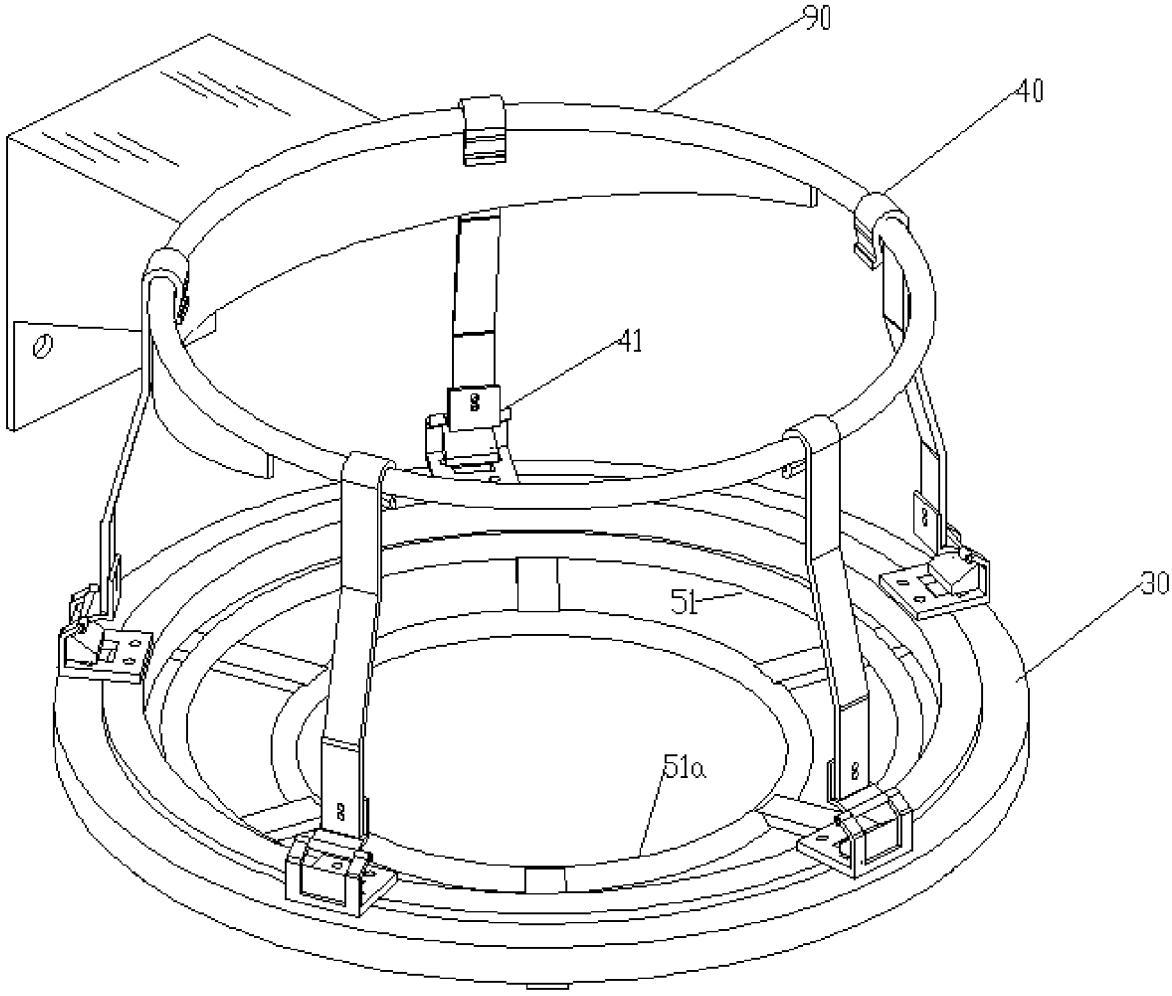
FIG. 2*a* is a perspective view of the first additional embodiment of the invention with a smaller facsimile hoop connected to a basketball hoop.

Now referring to FIG. 2*a* a perspective view of the first additional embodiment is shown. The modified facsimile hoop (51) has an additional smaller ring (51*a*). This smaller facsimile hoop (51) makes shots more difficult to score. This requires increased skill by the player to make the shot.

Figure 3:
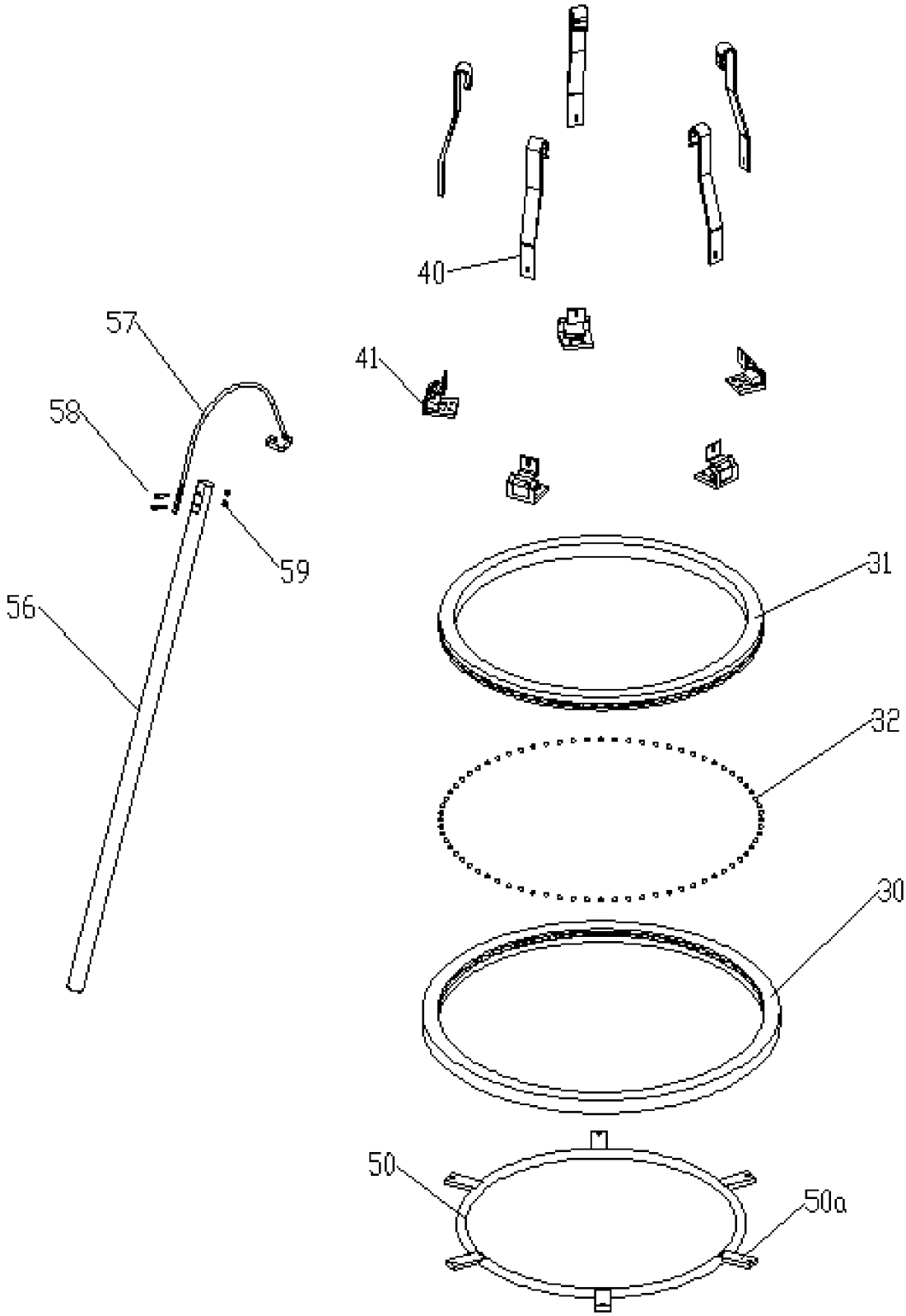
FIG. 3 is an exploded perspective view of the invention.

Referring now to FIG. 3 a perspective view of the initial embodiment of the device is shown exploded into the various individual components.

The facsimile goal (50) is attached to the outer bearing (30) via stays (50*a*).

A number of ball bearings (32) are sandwiched between the outer (30) and inner (31) bearings. Thus allowing them to move radially with respect to each other but not axially. This will be discussed further regarding FIG. 4 below.

The shepherds crook (55) consists of the pole (56), the hook (57), nuts (59), and bolts (58). The length of the pole (56) is long enough to allow installation onto the basketball goal.

Figure 4:
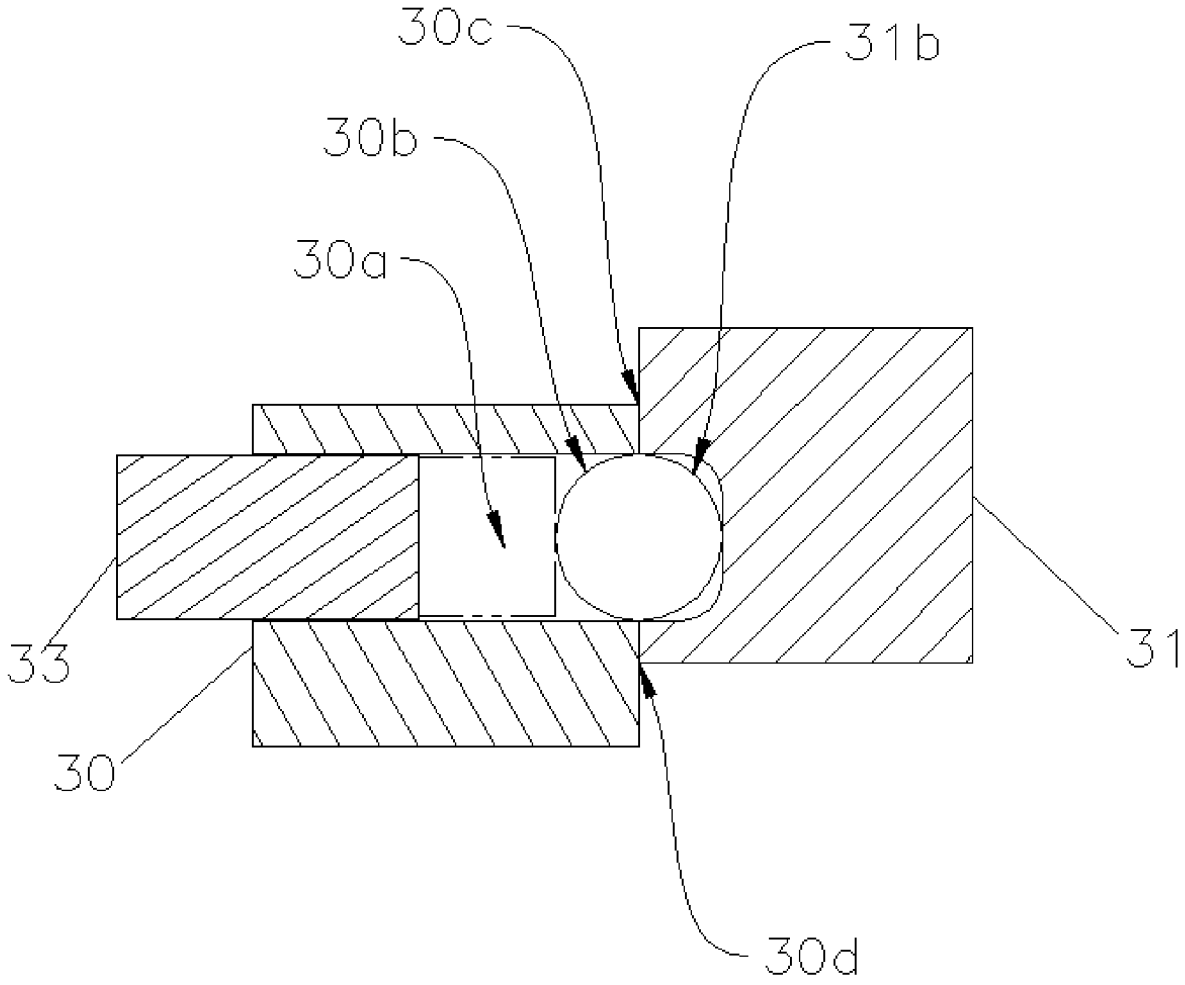
FIG. 4 is an enlarged cross-sectional view of the bearing.

Referring now to FIG. 4 a cross section of the outer bearing (30), the inner bearing (31), and a plug (33). There is a hole (30*a*) in the outer bearing (30) through which the ball bearings (32) may be loaded. There is a groove (30*b*) which runs along the inside of the outer bearing (30) and a corresponding groove (31*b*) which runs along the outside of the inner bearing (31).

A ball bearing (32) can fit between these two grooves (30*b* & 31*b*) and around the radius a plurality of them came be placed. Once there are a number of ball bearings (32) in place, the inner (31) and outer (30) bearings can freely rotate but cannot move upward or downward with respect to one another.

The plug (33) fills the hole (30*a*) in the outer bearing (30) so that the ball bearings (32) do not come out while allowing the ball bearings (32) to rotate.

Figure 5:
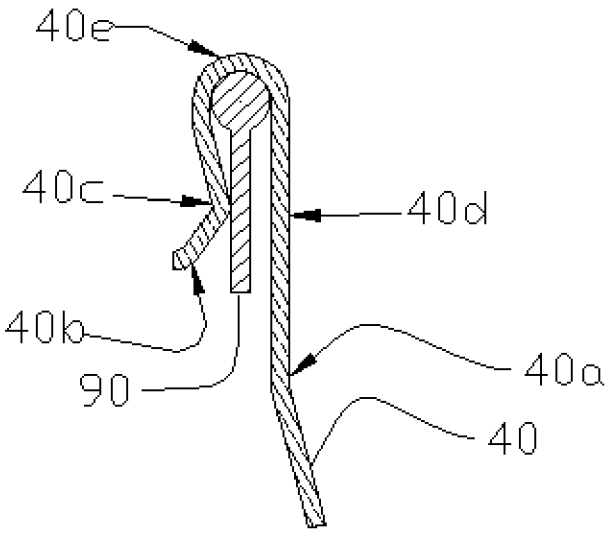
FIG. 5 is a cross section of a hook on the basketball rim.

Referring now to FIG. 5, a cross section is shown of the goal (90) with the hook (40) on it. The hook (40) has a bend (40*a*) in it so as to align it more or less parallel to the goal (90). The hook (40) is bent in area 40*e* to bend over and rest on the upper surface of the goal (90). The tip (40*b*) of the hook (40) is flared outward so that fitting it onto the goal (90) is easier. The gap between the two sides of the hook (40) for a brief distance, in areas marked (40*c*) and (40*d*), is smaller than the diameter of the goal (90). This helps to prevent the hook (40) from coming loose from the goal (90) inadvertently, such as when a basketball strikes it.

The hooks (40) are made of springy enough material to allow enough motion for insertion and removal but still stiff enough to hold onto the goal (90) when in use.

Figure 6:
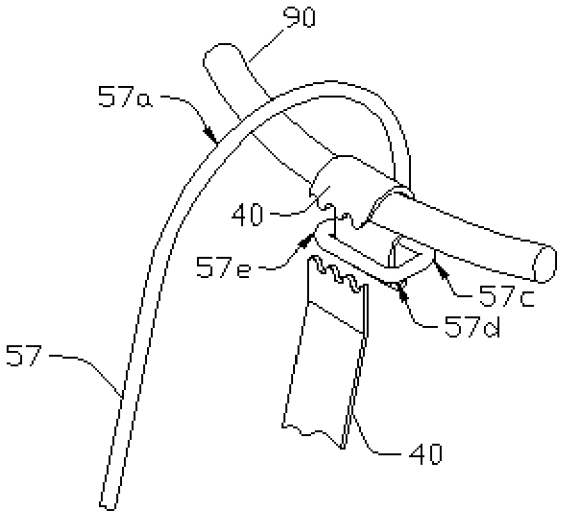
FIG. 6 a close up perspective view of the shepherds crook engaging a hook attached to the basketball goal.
Figure 6A:
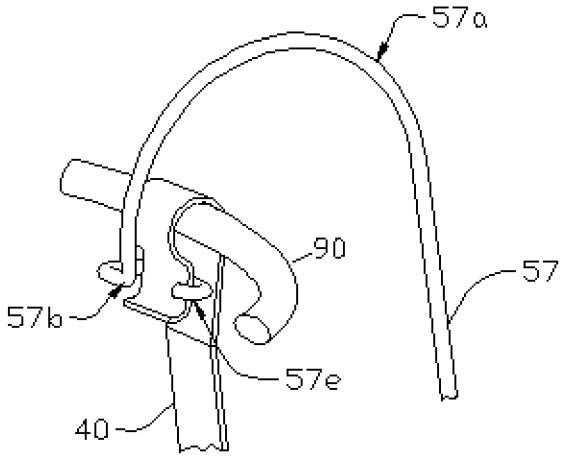
FIG. 6*a* is a reverse angle perspective view of the shepherds crook engaging a hook which is attached to the basketball goal.

Referring now to FIG. 6 and 6*a* the hook (40) is shown as positioned on the goal (90) when the device is installed on the basketball goal with the shepherds crook hook (57) positioned just after placing the hook (40) on the goal (90) or just before taking it (40) off of the goal (90). Section 57*a* of the shepherds crook hook (57) is bends up and over the goal (90) and then downward to engage the end of the hook (40). There are several bends (57*b*, 57*c*, 57*d*, 57*e*) in the tip of the shepherd crook hook (57) to allow it to engage the hook (40). The benefit of this engaging capability is to allow the shepherds crook hook (57) to pull the hook (40) outward to aid its placing on or taking off from the goal (90) as well as preventing the hook (40) from inadvertently disengaging from the shepherds crook (57).

The hook (40) is shown cut away so that the bends (57*b*, 57*c*, 57*d*, 57*e*) of the shepherds crook hook (57) can be seen more clearly. FIG. 6*a* is a reverse perspective view of the hook (40), goal (90) and shepherds crook hook (57)

Figure 7:
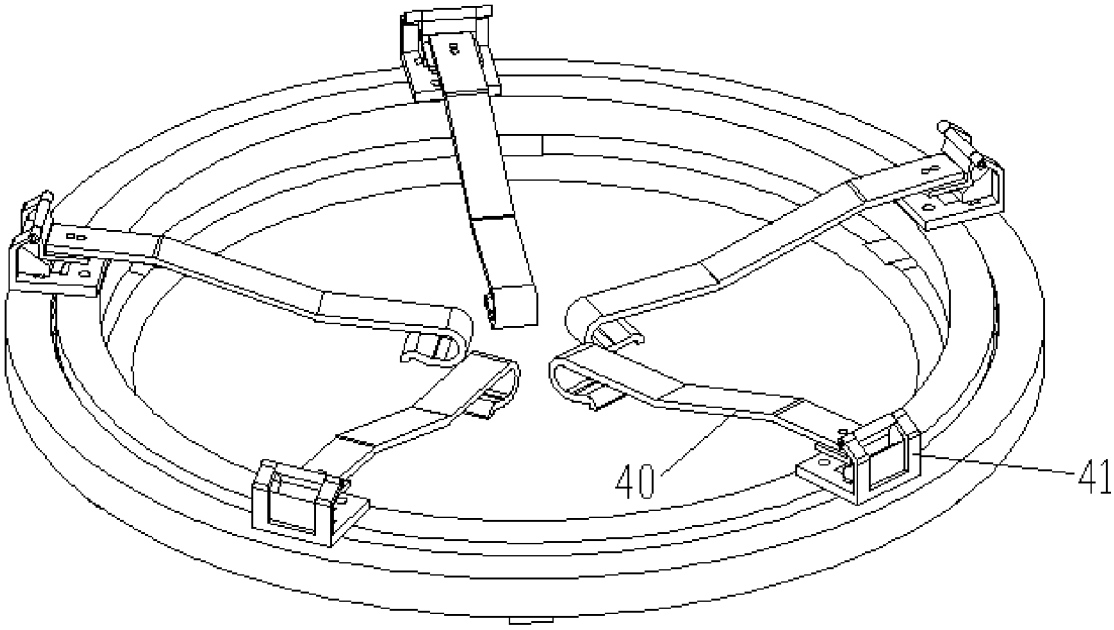
FIG. 7 is a perspective view of the invention with the hooks folded down.
Figure 7A:
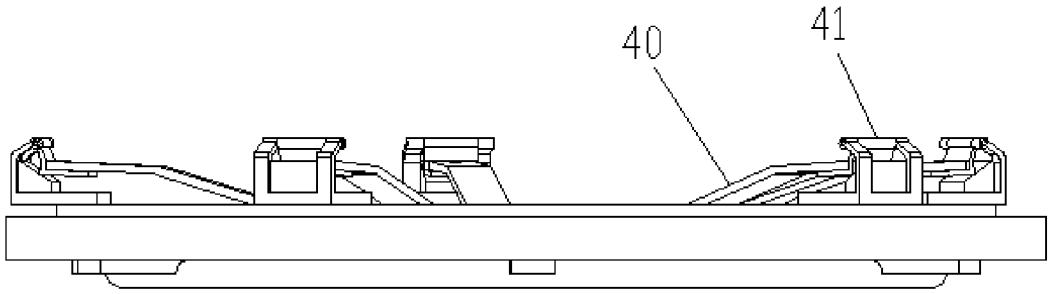
FIG. 7*a* is a plan view of the invention with the hooks folded down.
Figure 8:
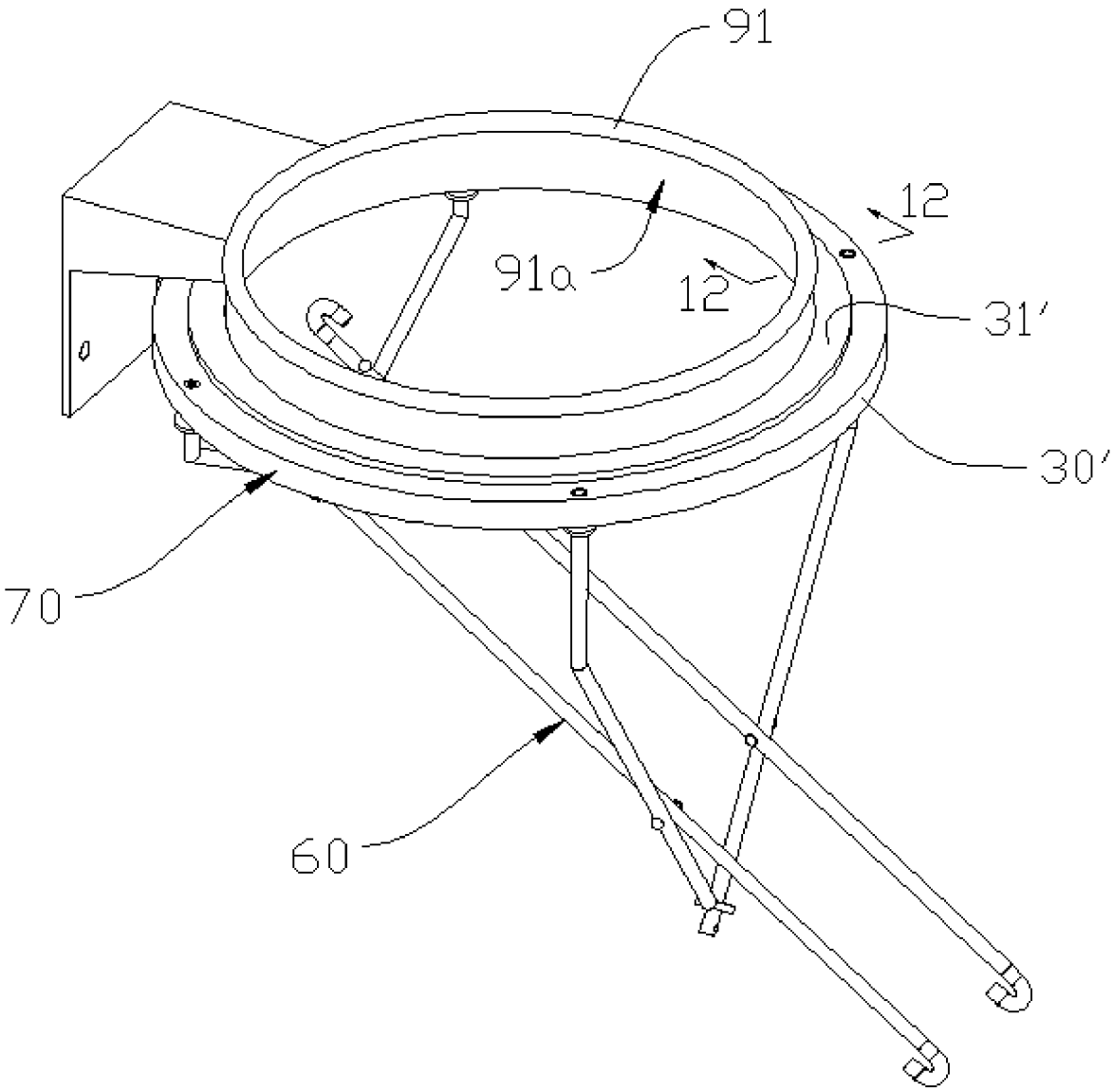
FIG. 8 is a perspective view of the second additional embodiment of the device.

Now referring to FIGS. 7 and 7*a*, a perspective and plan view of the device with the hooks(40) folded down is shown. The invention is substantially flat to permit easy shipping or storage. The hinges (41) are the latching type, which do not move as freely as regular hinges do. They also provide even higher resistance to rotation when closed as shown in FIGS. 7 and 7*a* whereby the hooks (40) will not easily rattle out of the position shown while being transported Referring now to FIG. 8, a perspective view of the second alternate embodiment is shown. The hooks (40) that were shown in the prior embodiment have been removed by attaching the inner bearing (31') directly to the goal support (9*a*). Unlike the primary embodiment that can be mounted to any basketball goal (90), this embodiment is actually part of the basketball goal (91). This provides a strong connection between the goal (91*a*) and the inner bearing (31').

The inner bearing (31') and outer bearing (30') are smaller than in the initial embodiment so that the inner bearing (31') mates with the support(91*a*). This connection will be discussed further in FIG. 12.

The facsimile hoop (50) of the prior embodiments has been replaced with a folding chute(60). This adds the functionality of having the return mechanism built in rather than be an additional component. Further the chute (60) can be installed and removed without a ladder by means of a shepherds crook (55') which is discussed below in FIG. 13. Thus it can be easily removed and stored when not in use. The chute (60) will be discussed in FIGS. 9 through 11*a*.

Figure 9:
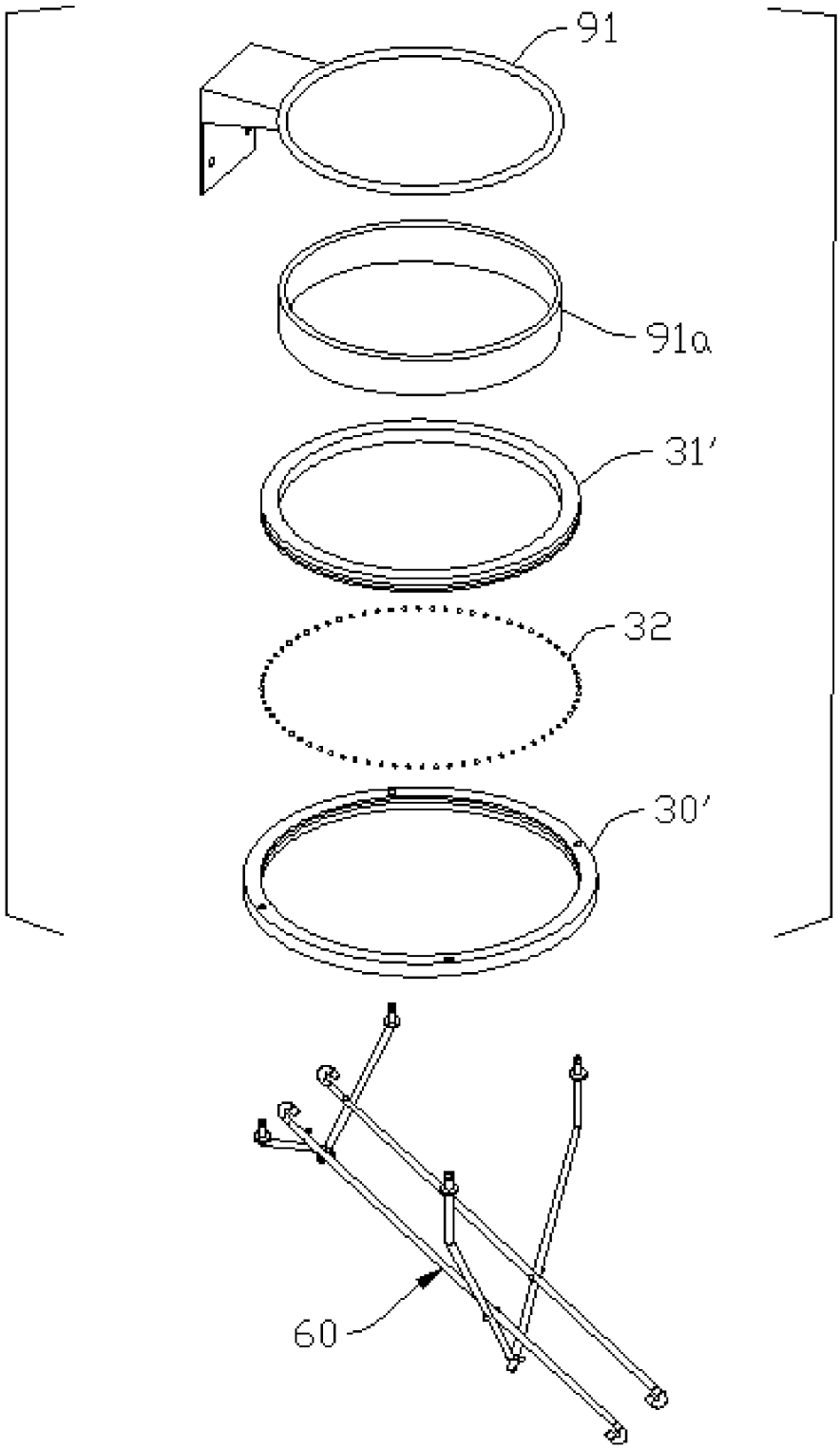
FIG. 9 is an exploded perspective view of the second additional embodiment of the device.

Referring now to FIG. 9 an exploded perspective view of the second additional embodiment. The goal-bearing assembly (70) consists of the inner bearing (31'), outer bearing(30'), ball bearings(32), and goal (91). The connection between the inner bearing (31') to the support (91*a*) are discussed in FIG. 12 below. The folding chute (60) is connected directly to the outer bearing outer bearing (30'). This will be discussed further in FIG. 12.

Figure 10:
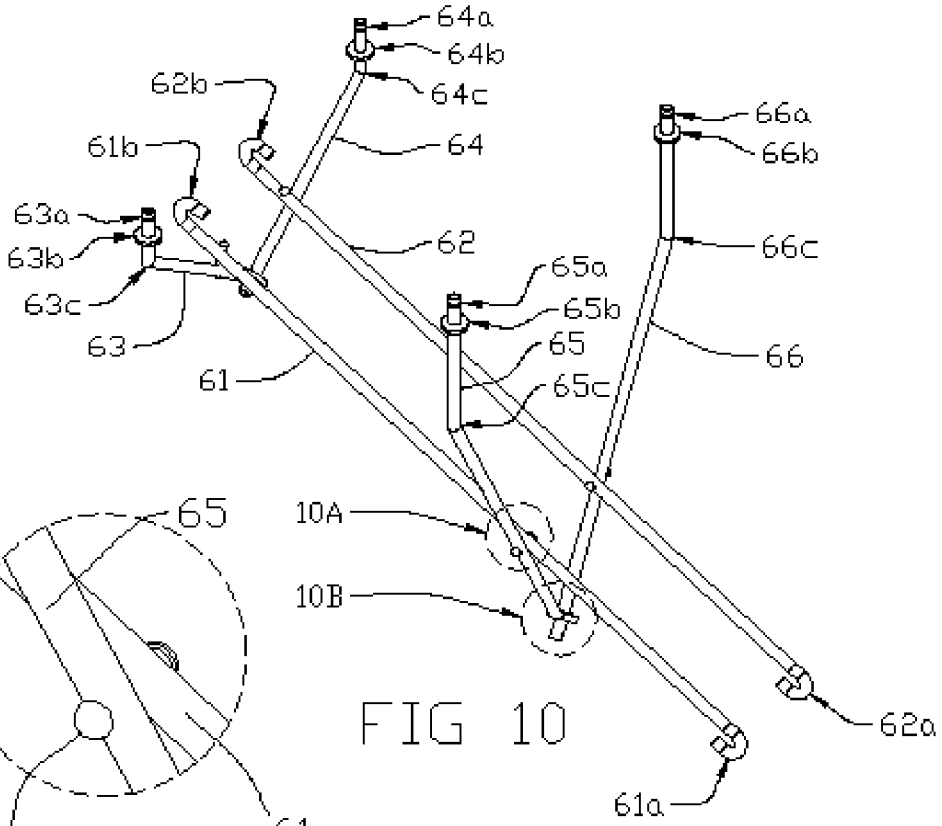
FIG. 10 is a perspective view of the folding chute

Now referring to FIG. 10 a perspective view of the folding chute assembly (60). The folding chute (60) consists of two rails, a left rail (61) and a right rail (62), which are curved at the bottom ends (61*a* and 62*a*) and top ends (61*b* and 62*b*) so as to prevent injury. Each rail (61, 62) is connected to two supports, front (65 and 66) and rear (63 and 64).

At the top end of each support (63, 64, 65, 66) is a detent notch (63*a*, 64*a*, 65*a*, 66*a*) into which fit detents (68) as will be described in further detail in FIG. 12. Each of the supports (63, 64, 65, 66) have bends in them (63*c*, 64*c*, 65*c*, 66*c*) allowing each support (63, 64, 65, 66) to move in toward the appropriate rail (61 and 62) and then on to its mating support (63&64, 65&66). The mate for the left rear support (63) is the right rear support (64). The mate for the left front support (65) is the right front support (66).

There is a washer (63*b*, 64*b*, 65*b*, 66*b*) mounted on each support (63, 64, 65, 66) below the detent notch (63*a*, 64*a*, 65*a*, 66*a*). The washers (63*b*, 64*b*, 65*b*, 66*b*) are used to install and remove the folding chute assembly (60) from the outer bearing (31') via the secondary embodiment's shepherds crook (55') without the use of a ladder. This will be discussed further regarding FIG. 13.

Figure 10A:
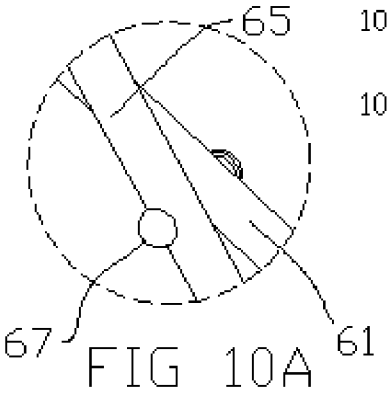
FIG. 10*a* is a close up perspective view of a hinge of the folding chute

Now referring to FIG. 10*a* a close up view of the left front support (65) to left rail (61) connection is shown. A pin (67) acting as an axle allows the left rail (60) and left front support (65) to rotate with respect to one another. Each of the other three connections (61, 63; 62, 64; 62, 66) works similarly. These four connections (61, 65; 61, 63; 62, 64; 62, 66) allow the chute (60) to fold. This folded chute (60) will be discussed further in FIGS. 11 and 11*a* below.

Figure 10B:
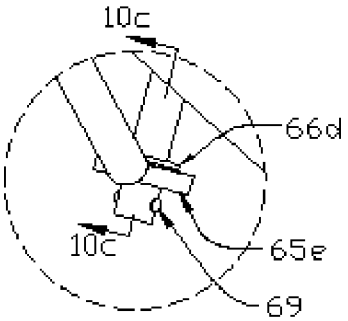
FIG. 10*b* is a close up perspective view of a tip of the two halves of the folding chute.
Figure 10C:
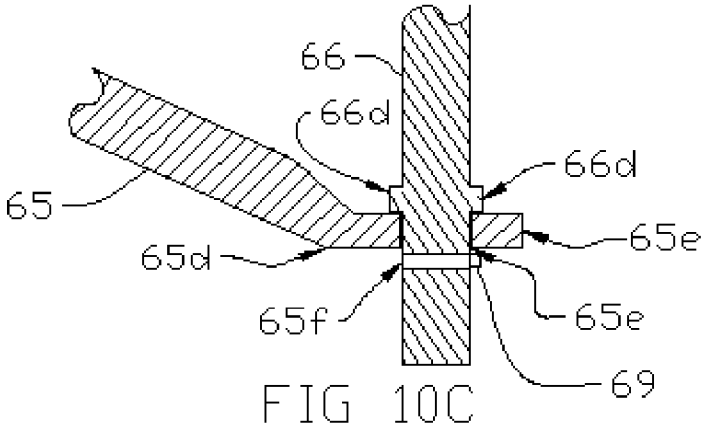
FIG 10*c* is a cross section of a tip of the two halves of the folding chute.

Now referring to FIG. 10*b* a close up view of the left front support (65) to right front support (66) connection is shown. The tip of the left front support (65*e*) has a hole in it which allows the tip of the right front support (66) to slide through it. FIG. 10*c* shows a cross section of this.

The right front support (66) has a enlarged section (66*d*) near the tip to allow only a certain portion of it through the left front support (65).

There is a detent pin (69) in the tip of the right front support (66). This serves to provide a force holding the left (65) and right (66) front supports together. The ball detent (69) is spring-loaded and prevents the right front support (66) from inadvertently coming out of the left front support (65). However with enough force the two can be separated for disassembly and storage. The left rear support (63) and right rear support (64) go together similarly.

Figure 11:
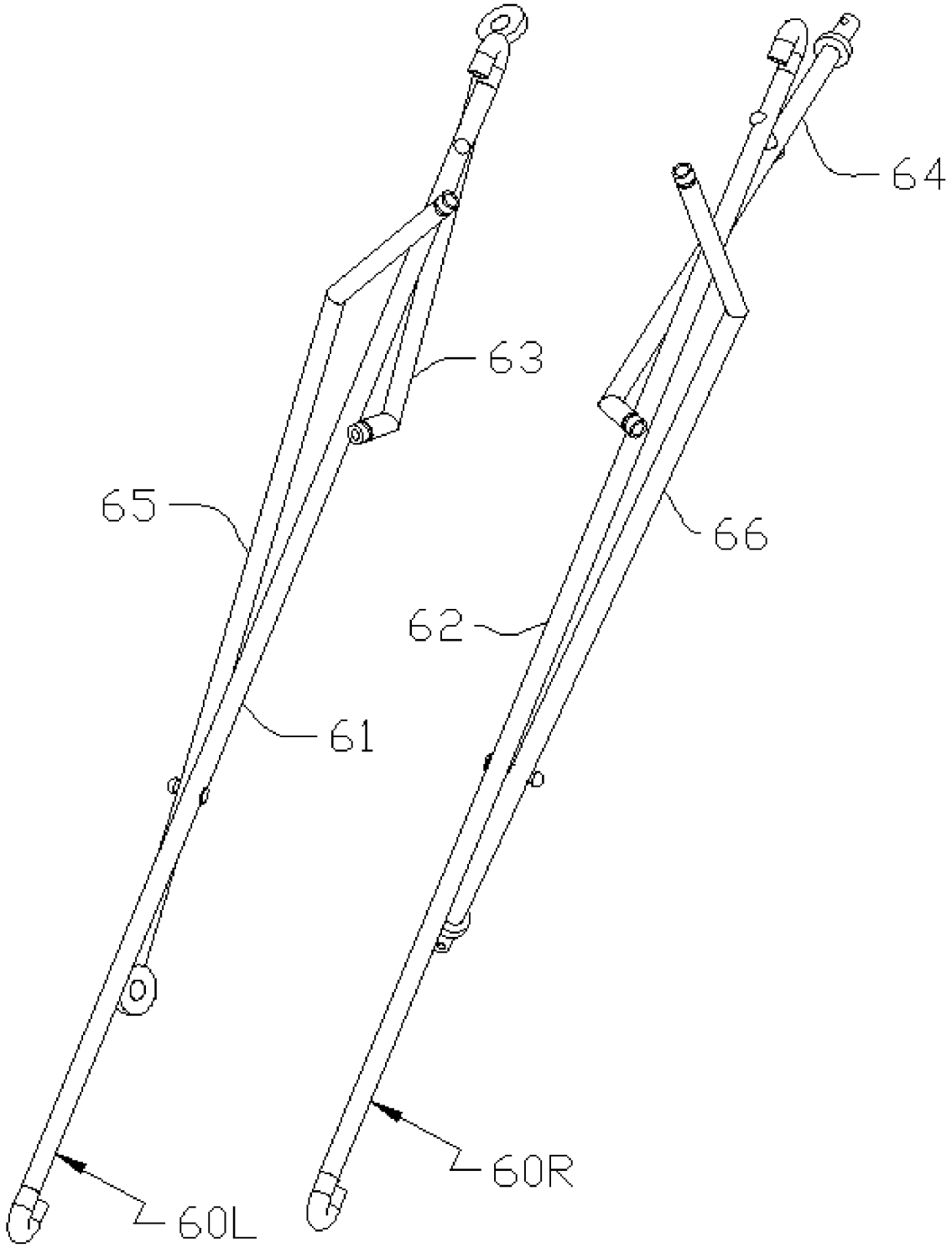
FIG. 11 is a perspective view of the folding chute with the two halves folded.

Now referring to FIG. 11 a perspective view of the folding chute (60) disassembled into two pieces is shown. The chute is now separated into two halves a left half (60L) and a right half (60R). Each of the supports (63, 64 and 65, 66) has been rotated to be substantially parallel to the rails (61 and 62). Thus the folding chute (60) can be made much smaller when folded than when unfolded.

Figure 11A:
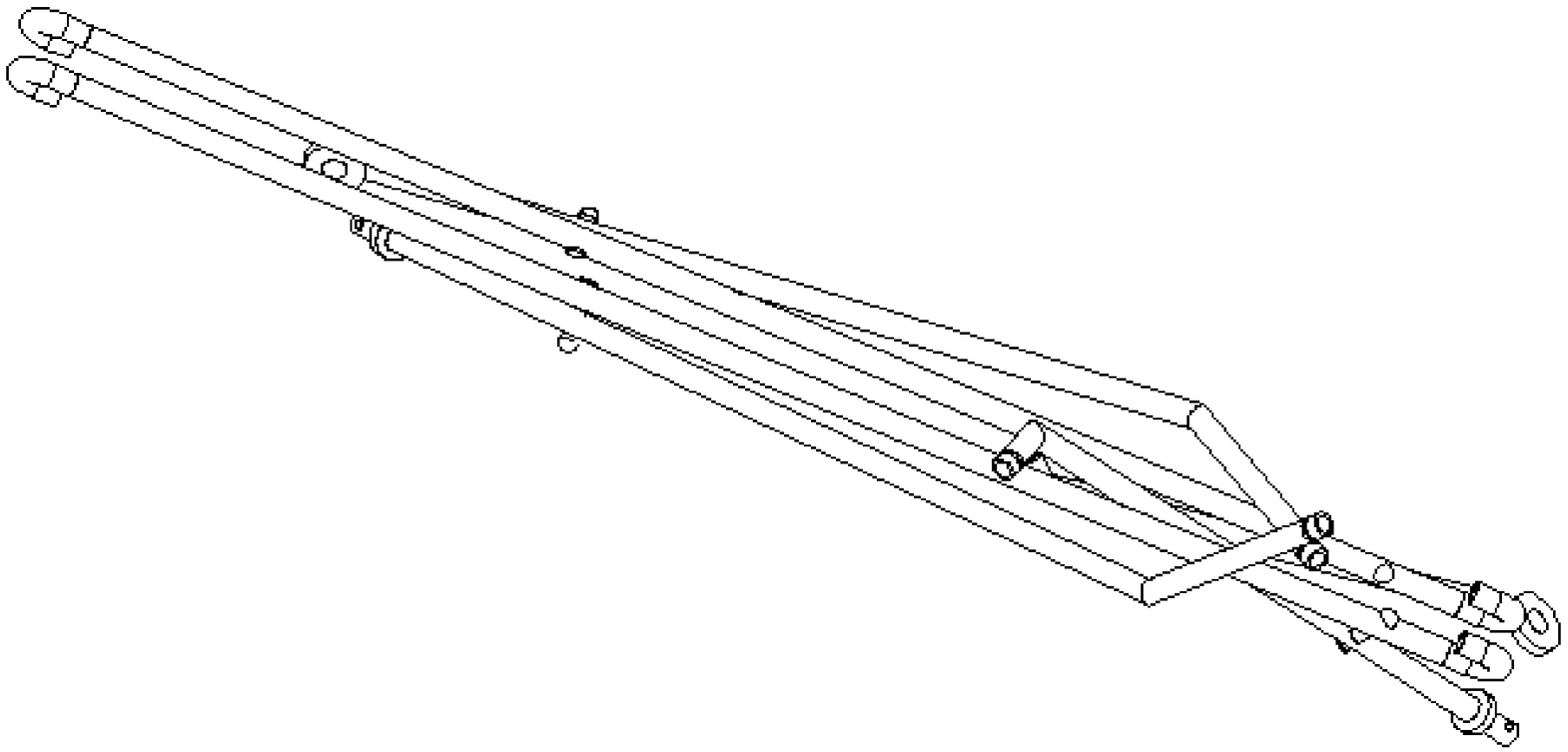
FIG. 11*a* is a perspective view of the folding chute with the two folded halves and placed together.

FIG. 11*a* shows a perspective view of the two halves (60R, 60L) folded and placed together. The volume taken up is very small and consequently the folding chute (60) is now more easily transported and stored.

Figure 12:
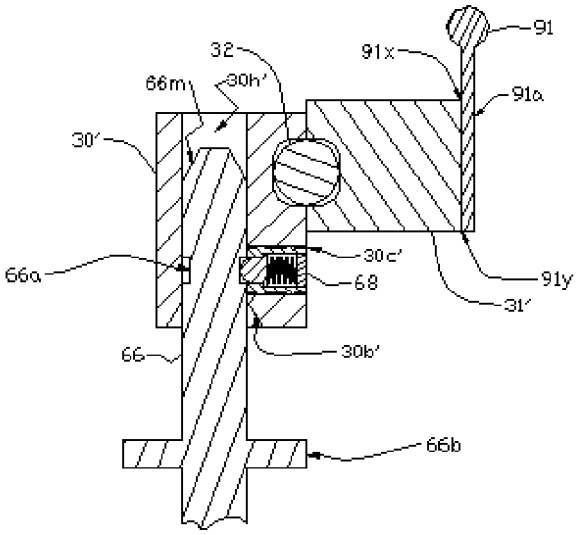
FIG. 12 is a cross section of the folding chute to bearing to basketball goal interface.

Now referring to FIG. 12 a cross section of the bearing (30, 31 and 32) to goal support (91*a*) interface. The inner bearing (31') is just large enough to allow it to fit around the support (91*a*). The inner bearing (31') and goal support (91*a*) are permanently connected by means such as welding in the area between (91*x*) and (91*y*).

The mating of the inner bearing (31') ball bearings (32) and outer bearing (30') is the same as that described earlier in FIG. 4.

The right front folding chute support (66) is shown in its mating hole in the outer bearing (30*h'*). The ball detent (68) holds the support in place by sliding into the detent groove (66*a*) in the right front support (66). The bottom end of the inner bearing hole is chamfered(30*b'*) as shown to ease the fitting of the right front support (66) into it. The top of the support (66) is also chamfered (66*m*) to ease the fitting into the outer bearing (30*h'*). The other three supports (62, 64 and 65) fit similarly into the outer bearing (30').

The support (66) is installed or removed by pushing upward or pulling downward with enough force to overcome the holding force of the detent (68). The washer (66*b*) allows the shepherds crook (55') to grab the support (66) and insert it and remove it from the outer bearing (30'). The other three supports (63, 64, and 65) can be similarly inserted and removed with the shepherd crook (55'). Thus the folding chute (60) can be inserted and removed without the use of a ladder.

Figure 13A:
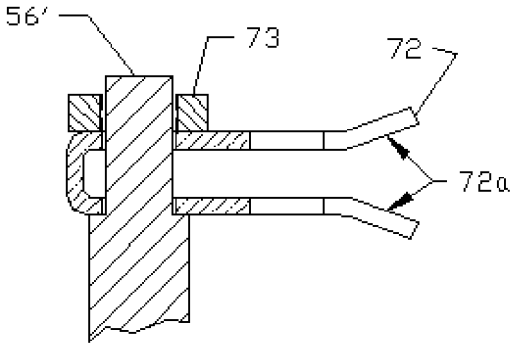
FIG. 13*a* is a cross section of the top of the secondary embodiments shepherds crook.
Figure 13:
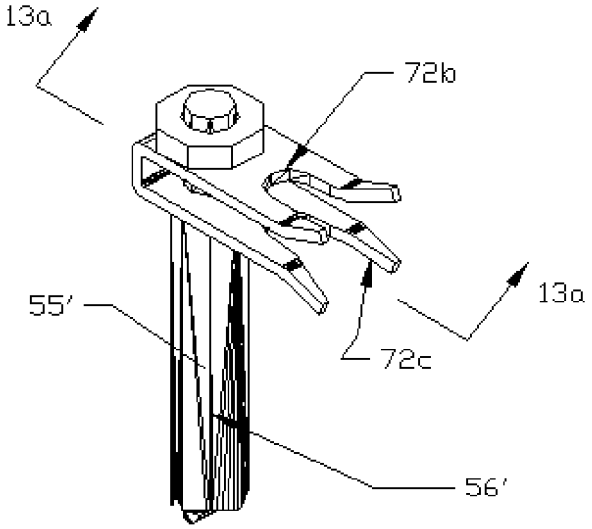
FIG. 13 is a perspective view of the top of the secondary embodiment's shepherds crook.

Now referring to FIG. 13 a perspective view of the secondary embodiment's shepherds crook (55'). It consists of a stay (72) attached to a long pole (56')that is shaped to fit engage the washer (66*b*). Thus the support (66) can be inserted to or removed from the outer bearing (31') without the use of a ladder. The stay (72) has a cut in the top and in the bottom (72*b*) to allow engagement around the support (66). This cut (72*b*) is chamfered (72*c*) to allow easier engagement with the support (66). FIG. 13*a* shows that the stay (72) widens at one end (72*a*) to allow easier engagement of the washer (66*b*).

Operation

To use the device, first it must be attached to the basketball goal. Assuming the device is folded as shown in FIG. 7 the hooks (40) need to be unfolded to approximately the position shown in FIG. 1. Next a chute-only device needs to be attached to the facsimile hoop (50). Next the shepherd's crook (55) is attached to one of the hooks (40). The device can then be lifted up to the basketball goal (90). Once at this height the first hook (40) can be placed on the hoop (90) and the shepherds crook (55) removed. The remainder of the hooks (40) can be similarly brought into place by use of the shepherds crook (55).

Now the device is ready to be used. Basketballs making it through the goal will now be directed away from the basketball goal. Rotating the device quickly changes the return direction of the basketball to whichever area of the basketball court is desired without the need of a ladder.

Removal is the reverse of installation. Once the device is removed from the basketball goal, the hooks can be folded down so the device can be easily transported and stored. Installation and removal of the first additional embodiment is the same as the initial embodiment. The key difference being that shots are more difficult to make since the effective size of the goal has been reduced. Unless the basketball falls through the center of the smaller facsimile hoop they will bounce out of the basketball hoop and the shot will not be made.

The operation of the second additional embodiment is similar to the prior embodiments, but the initial installation is different. The second additional embodiment consists of two major assemblies; the goal-bearing assembly (70) and the folding chute assembly (60). For initial installation a ladder is required or the backboard needs to be lowered to a height the user can reach. Subsequent removal and installation of the folding chute (60) can be completed without a ladder or moving the backboard via the use of a second additional embodiment's shepherds crook (55').

Installation is as follows. The regular basketball goal is removed if present. The goal-bearing assembly (70) is attached. Now the goal-bearing (70) assembly is ready to have the folding-chute (60) attached to it. This can either take place while the user is standing on the ladder or the basketball backboard is lowered.

The folding chute (60) is assembled as follows. The two sides of the folding chute (60L & 60R) are unfolded. This is accomplished by rotating the four supports (63, 64, 65, 66) to be at approximately right a right angle to the rails (61, 62).

The two halves are then connected together left rear (63) to right rear (64) and left front (65) to right front (66). Now the folding chute (60) is completely unfolded and assembled and can be attached to the goal-bearing assembly (70). It appears as shown in FIG. 10.

Attaching the folding chute (60) without a ladder onto the hoop/bearing assembly when it is at full height is accomplished by attaching the shepherds crook (55') to the support (66) around the washer (66*b*), lifting until the chute (60) aligning the support (66) with the hole in the outer bearing (30*h*) and pushing up with enough force to overcome the force of the ball detent (68) so that it latches into place onto the ball detent notch on the support (66*a*).

The shepherds crook (55') is then removed. In a similar fashion the other three supports (63, 64, 65) are installed into the outer bearing (30'). Thus the folding chute (60) is installed without the use of a ladder.

Basketballs making it through the goal will now be directed away from the basketball goal. Rotating the chute (60) can change where the ball is returned and the chute (60) can be removed or installed without a ladder.

Removal of the folding chute without a ladder is accomplished by reversing the installation method. The shepherds crook (55') grabs the support (66) around the washer (66*b*). By pulling down with enough force to overcome the force of the ball detent (68). The other three supports are similar removed. The chute (60) is then lowered.

The two halves (60L, 60R) of the folding chute (60) then are removed from one another by pulling the two right supports (64 and 66) out from the two left supports (63 and 65).

Each half (60L and 60R) can then be made smaller by folding the supports (63, 64, 65, 66) approximately 90 degrees such that the are substantially parallel with the two center rods (61 and 62) as shown in FIG. 11. The two halves (60L, 60R) are then put together as shown in FIG. 11*a*.

The folding chute (60) is now very small and ready for transport and storage while the goal-bearing assembly (70) is ten feet up out of harms and thieves way.

Conclusion, Ramification and Scope

A better mechanism to return a ball to any area of the court is disclosed which consists of folding hooks, bearing and facsimile hoop. The device is portable folding to a smaller size for easy transport and storage. It allows chute-only devices to return balls to any area of the court and mounts onto the basketball goal without the use of a ladder.

Additional objects and advantages are achieved in each of two additional embodiments that are disclosed that show variations to the facsimile hoop, return mechanism, goal attachment mechanism and bearing of the initial embodiment. A smaller facsimile hoop makes shots harder requiring more accurate shooting. A folding chute which provides an integrated return device of reduced weight replaces the facsimile hoop. The bearing size is reduced in size and integrated with the goal to allow the folding hooks to be replaced with a solid connection to the basketball goal eliminating interference with the top of the basketball goal and making theft more difficult. All of the embodiments can be attached and removed without the use of a ladder.

This device is small, lightweight and portable. The user can take more shots each practice session because balls are returned rather than fetched from whatever area of the court they were shot.

There are numerous variations from the disclosed embodiments that are within the scope of this invention many of these are explored below.

The larger elements of the various embodiments may be interposed. Two attachment-mechanisms are disclosed one removable in the initial embodiment and one fixed in the second additional embodiment. Two rotated mechanisms are disclosed a facsimile hoop in the initial embodiment and a folding chute in the second additional embodiment. These may be interposed. The removable attachment mechanism may be used with the folding chute. The fixed attachment mechanism may be used with the facsimile hoop.

The bearing size could be different than that depicted. The bearing is shown larger than the basketball goal (91). It could be smaller than the basketball goal (90) achieving the same effect as the disclosed smaller facsimile hoop (51), shown in FIG. 2*a*. In this case shots would be harder to make with the additional benefit of reducing the overall weight of the device, since the bearing is one of the heavier elements of the device.

The inner (31) and outer (30) bearing connections to the hinges (41) and facsimile goal (50) could be swapped. That is, the hinges (41) could be connected to the outer bearing (30) and the facsimile goal (50) could be connected to the inner bearing (31) rather than the other way around as the drawings show. This may require that the stays (50*a*) be shaped differently.

Variations to each of the smaller elements are also possible within the scope of this invention. Some of these variations are discussed below.

Two sizes of facsimile hoop are shown. Other shapes and sizes can be employed. For example the facsimile hoop (50) does not need to be exactly the toroidal shape as shown. It only needs to be shaped to allow the chute only device to be attached as well as attaching to the outer bearing (30). For example, it could be made of two or more separate pieces.

The modified facsimile hoop (50') restricts the ball from going through the goal (90). There are other ways to achieve this. As mentioned above the bearing could be smaller. Alternatively others parts, such as the hook (40) or goal support (91*a*) for goal (91) may be shaped to restrict the passage of the ball.

For the hooks (40)-to-hinges(41), hinge(41)-to-inner-bearing(31), facsimile-hoop(50)-to-outer-bearing(30) connection a variety of methods could be used. A few of the alternatives are, bolts or other fasteners such as quick release, welding, gluing, fabricating as one piece.

The purpose of the bearing is to allow the two sides (30 and 31) to move with respect to one another and in general to have the force required for this motion to take place to be relatively small but not zero so it does not too easily move out of place. It also needs to be strong enough to withstand the force of basketballs repeatedly hitting it.

Those of skill in the art will appreciate that a variety of other bearing types also lie within the scope of the present invention. The bearing could use no balls (32), that is the outer (30) and inner (31) parts could be constructed to slide smoothly against each other without the need of further components. The outer (30) and inner (31) bearings could be shaped to use instead of balls, some other suitably shaped object or objects such as rollers or needles. Other types of bearings could be employed such as air or electro-magnetic, to name a few.

Those familiar with the state of the art will appreciate the number of other methods with which the hooks (40) may be attached to the inner bearing (31). Here are some example alternatives methods. They may be directly bolted on to the outer bearing (31) rather than connected via hinges (41). They may be welded on or otherwise directly fabricated as one piece with the bearing (31). There may be some quick be quick disconnect mechanism with which the hooks are held to the bearing (31). This would allow the hooks (40) to be removed from the bearing (30) when not in use. The shortcoming of this arrangement is that once removed they may be lost.

There are variations to the shepherds crook (55 and 55') that are within the scope of this invention. For example the shaft (56) could be collapsible or of inter-mating pieces to allow it to be made smaller for easier transportation. The shape may be different and still achieve the same purpose of getting on and off of the basketball goal (91) without a ladder.

Those of skill in the art will appreciate that a variety of other bearing to basketball-goal architectures which also lie within the scope of the present invention. The hooks (40) could be made to attach to some other part of the basketball goal or backboard or to some other item near the nearby. In fact they do not need to be hooks at all; however, they must fulfill the purpose of holding the device rigidly with respect to the basketball goal (90). The hooks (40) could have a means by which they are more permanently held to the goal (90) such as screws between area 40*c* and 40*d* shown in FIG. 5. The goal (90) could be modified to accommodate some sort of quick release mechanism to which the apparatus is attached. An example of this a variation to the second additional embodiment. The inner bearing (31') and hoop support (91*a*) can be temporarily connected rather than permanently connected as described. Bolts or ball detents or some other means could accomplish this. In this way the bearing assembly (70—less the goal 91) could be removed from the goal (91).

Other chute only devices could be modified to attach directly to the outer bearing (30'). An example of this is adding a means for a chute only device to connect using the mechanism shown in FIG. 12. Another alternative is for the chute only device to snap over, otherwise connect directly to, the outer bearing (30) rather than connecting to the facsimile goal (50).

A netting structure could be added to bring all balls that come close to the hoop through the hoop and thus the return mechanism of this device. The downside of such an arrangement is that is would add to the complexity of the device. It would also reward those shots that are close by returning them as opposed to only returning, and thus only rewarding, made shots.

While this invention has been described in conjunction with specific embodiments, it is evident that many alternatives, modifications and variations will be apparent to those skilled in the art.

Thus the scope of the invention should be determined by the appended claims and their legal equivalents, rather than by the examples given.

Accordingly, the preferred embodiments of the invention as set forth herein are intended to be illustrative, rather than limiting. Various changes, some of which are contemplated above, may be made without departing from the spirit and scope of the invention as defined in the following claims and their legal equivalents

The invention claimed is:

1. A basketball training device for use on a playing court for returning to a shooter said basketballs which have been shot into a basketball goal, said basketball goal including a rim, a rim support and a net descending from the rim said basketball training device comprising:

a plurality of roller bearings sandwiched between an inner rigid bearing having an inner diameter and an outer diameter and an outer bearing having an inner diameter and an outer diameter;

said inner rigid bearing attached to said basketball goal and said outer rigid bearing rotating freely with respect to said basketball goal;

an attachment attached to said outer rigid bearing, said attachment selected from the group consisting of:

(a) a rigid facsimile goal having an inner diameter, an outer diameter and a chute device attached to said rigid facsimile goal, wherein said basketball passes through said basketball goal; said inner bearing, said outer bearing and said chute device are returned to said playing court at an angle determined by a rotation of said outer rigid bearing; or (b) a chute having an interior through which the basketball is channeled away from said basketball goal at a preselected direction by a rotation of said outer rigid bearing and wherein said basketballs are returned to any area of said playing court.

2. The training device according to claim 1, further comprising a long rigid shepherd's crook having a looping end and a tip attached to said looping end; said crook engages hooks attached to said rim, wherein a ladder is not required for either installation or removal of the training device.

3. The training device according to claim 1, futher comprising a shepherd's crook for removably attaching said chute to said outer bearing; said chute further including hooks, wherein said shepherd's crook engages; whereby a ladder is not required for installation, and removal of said chute.

4. The training device according to claim 1, further comprising a plurality of hooks securing attached to said rim; said hooks are made of a springy material attached to said inner rigid bearing of said training device; said hooks having loop portions to curve around said rim; a portion descending below said rim; a portion passing closely to an opposite side of said hook; and a portion which flairs away from said opposite sides; wherein said hooks are easily mounted but not easily dislodged.

5. The training device according to claim 4, comprising said plurality of hooks fold by means for allowing one part of said hook to rotate with respect to another part of said hook, allowing the training device to be substantially reduced in size for transport and storage.

6. The training device according to claim 1, wherein said chute is formed of a plurality of portions, said portions are removably attached to one another; said portions further include elements which can rotate allowing said chute to be substantially reduced in size for transport and storage.

7. The training device according to claim 2, said basketball goal further including a passage which is obstructed by an element; said clement selected from the group consisting of: said plurality of roller bearings; said facsimile goal, said plurality of hooks, and said chute wherein said basketball will not easily pass through said basketball goal.

8. The training device according to claim 1, said training device does not rest on said playing court, wherein said training device does not impede said playing court.

9. The training device according to claim 1, said inner bearing is attached to a goal support formed on said basketball goal, wherein said basketball path is not altered when said goal support is struck.

* * * * *